US006269490B1

(12) United States Patent
Suski et al.

(10) Patent No.: US 6,269,490 B1
(45) Date of Patent: Aug. 7, 2001

(54) SPLASH PROOF URINAL DEODORANT RECEPTACLE

(76) Inventors: Michael F. Suski; Michael R. Suski, both of 313 N. Elms Rd., Flushing, MI (US) 48433

( * ) Notice: Subject to any disclaimer, the term of this patent is extended or adjusted under 35 U.S.C. 154(b) by 0 days.

(21) Appl. No.: 09/550,052

(22) Filed: Apr. 14, 2000

(51) Int. Cl.[7] ..... E03D 13/00
(52) U.S. Cl. ..... 4/309; 4/222.1
(58) Field of Search ..... 4/309, 222.1, 222

(56) References Cited

U.S. PATENT DOCUMENTS

| | | | | |
|---|---|---|---|---|
| D. 353,445 | | 12/1994 | Morad | D23/261 |
| 487,130 | | 11/1892 | Schoen . | |
| 1,880,962 | * | 10/1932 | Koppelman | 4/309 |
| 3,824,633 | | 7/1974 | Van Vlahakis | 4/109 |
| 4,103,367 | | 8/1978 | Kaufer | 4/222 |
| 4,135,261 | | 1/1979 | Uhrman | 4/222 |
| 4,143,431 | | 3/1979 | Goncalves | 4/231 |
| 4,574,400 | | 3/1986 | Annowsky | 4/222.1 |
| 4,574,403 | | 3/1986 | Dintemann et al. | 4/309 |
| 4,615,054 | | 10/1986 | Buecheler et al. | 4/231 |
| 5,165,119 | | 11/1992 | Yamato | 4/309 |
| 5,336,424 | * | 8/1994 | Van Vlahakis et al. | 252/89.1 |
| 5,365,616 | | 11/1994 | Morad | 4/309 |
| 5,465,901 | | 11/1995 | Paine, Jr. | 229/407 |

* cited by examiner

*Primary Examiner*—Gregory L. Huson
*Assistant Examiner*—Huyen Le
(74) *Attorney, Agent, or Firm*—Jacobson Holman, PLLC

(57) ABSTRACT

A deodorant and urine dispersing device for placement in a urinal and including a receptacle mounted on a flexible base pad having an opening for alignment with the outlet opening in a urinal and including vertically spaced urine dispersing filters each of which includes a plurality of rod-like members oriented in spaced, parallel relation with the rod-like members in the upper dispersing filter being parallel to the path of urine flow and the rod-like members in the lower dispersing filter being perpendicular to the rod-like members in the upper dispersing filter. Each of the rod-like members have a generally cylindrical upper surface and a lower edge defined by downwardly converging surfaces forming a V-shaped configuration with the lower apex defining a narrow edge to reduce capillary action and reduce splashing of urine when it engages the dispersing filters. In one embodiment of the invention, the receptacle includes a lower shelf formed by a plurality of spaced parallel supporting rods with a front wall of the receptacle having an opening above the shelf to enable a deodorant block or cake to be easily inserted into the receptacle. In another embodiment of the invention, the receptacle includes only upper and lower urine dispersing filters, is substantially shorter in height and includes a flexible base pad.

20 Claims, 10 Drawing Sheets

SPLASH PROOF URINAL DEODORANT RECEPTACLE

BACKGROUND OF THE INVENTION

1. Field of the Invention

The present invention relates generally to receptacles and pad assemblies for urinals and, more particularly, to splash proof urinal receptacles which have dispersing filters for preventing splash back from the urinal toward the urinal user or other surfaces. In one embodiment, the assembly receptacle holds a deodorant block in the urine flow path and includes a pair of vertically spaced urine dispersing filters which prevent urine back splash. The assembly also includes a flexible base pad having an opening for alignment with the outlet opening in the urinal, and the dispersing filters are spaced above the deodorant block to disperse urine flow over the block. The vertically spaced dispersing filters include a plurality of rod-like members oriented in spaced, parallel relation with the rod-like members in the upper dispersing filter being parallel to the path of urine flow and the rod-like members in the lower dispersing filter being perpendicular to the rod-like members in the upper filter.

In another embodiment of the invention, the receptacle includes only upper and lower dispersing filters and does not include a deodorant block. The receptacle in this embodiment of the invention is also attached to a flexible base pad which includes a large discharge opening aligned with the urinal outlet. In this embodiment, the receptacle is shorter in height, uses less material and is constructed in a manner to be inexpensive and disposable.

2. Description of the Prior Art

Deodorant block holders are commercially available and generally include a flexible pad with a perforate receptacle on the upper surface of the pad receiving a deodorant block. Replacement of the deodorant block is somewhat difficult and the construction of some presently available commercial devices utilize upwardly facing flat surfaces which cause splashing of urine when urine flow impacts against the flat surfaces. The following U.S. patents disclose devices for positioning in or on urinals.

| | | |
|---|---|---|
| 487,130 | 4,143,431 | 5,165,119 |
| 3,824,633 | 4,574,400 | 5,365,616 |
| 4,103,367 | 4,574,403 | 5,465,901 |
| 4,135,261 | 4,615,054 | Des 353,445 |

The above patents disclose structures associated with urinals to support deodorant blocks in the flow path of urine and include screen structures and slotted receptacles to permit contact of urine with the deodorant block and enable discharge of urine to the outlet of the urinal. The prior patents, however, do not disclose the specific structural arrangement of the embodiments of the present invention. Specifically, the prior art does not disclose a receptacle for a deodorant block which includes vertically spaced upper and lower dispersing filter elements above the deodorant block for more effectively dispersing urine flow and avoiding surface flow of urine along the surfaces of the dispersing filter and receptacle due to capillary action. Further, the prior art does not show the specific construction of the receptacle, dispersing filter assembly and flexible base pad with a large center opening with the structure enabling replacement of the deodorant block easily and expeditiously. Finally, the prior art does not disclose urinal receptacles with vertically spaced dispersing filters supported from a flexible base pad with each dispersing filter including spaced parallel rod-like members having a convexly curved upper surface and a V-shaped lower surface.

SUMMARY OF THE INVENTION

The splash proof urinal receptacle and pad assembly of the present invention includes a plastic receptacle connected with a flexible resilient base pad which includes a large central opening for alignment with the outlet of a urinal when the receptacle and pad assembly are placed in the urinal. The pad supports the receptacle in the urinal in a stable position with the upper end of the receptacle facing upwardly for positioning in the flow path of urine. The receptacle preferably has a generally square or rectangular shape and is provided with upper and lower urine dispersing filters with each dispersing filter including a plurality of spaced parallel rod-like members. The rod-like members in the upper dispersing filter are oriented at a substantial angle rotation in relation to the rod-like members in the lower dispersing filter for more effective dispersion of the urine. Preferably, the rod-like members in the lower dispersing filter are approximately perpendicular to the rod-like members in the upper dispersing filter.

The rod-like members in each of the dispersing filters includes a unique cross-sectional configuration. Each rod-like member has a generally semi-cylindrical upper surface and a substantially V-shaped lower surface to define a sharp bottom edge. It has been found that this configuration produces two very beneficial results. First, the convexly curved upper surface facilitates dispersion of the urine flow and eliminates flat surfaces which have a tendency to cause splash back of the urine toward the urinal user. Second, the V-shaped lower surface substantially reduces the capillary action of the urine along the surfaces of the rod-like members and thus facilitates separation of the urine droplets from the rod-like members. It has further been found that the upper and lower dispersing filters constructed in accordance with the present invention should be spaced apart a sufficient distance in order to achieve the separation of the urine droplets from the rod-like members of the upper filter. In particular, the bottom edge of the V-shaped lower edge of the upper filter rod-like members should be spaced a distance of at least about ¼ inch above the apex of the convexly shaped upper surface of the lower filter rod-like members. In addition, it has been found that the rod-like members in each of the upper and lower filters should preferably be spaced from each other a distance of between about 1/16 inch and ⅛ inch.

In one embodiment, a deodorant block is supported on a shelf below the lower dispersing filter and the dispersed urine comes into contact with the deodorant block as it proceeds toward the base pad and is discharged through the opening in the base pad. In this embodiment of the invention, the receptacle includes a front wall with an opening and a shelf defined by a plurality of rod-like members positioned below the bottom of the opening to enable easy insertion and removal of the deodorant block. In another embodiment of the invention, the receptacle and pad assembly is designed to be disposable. The receptacle includes only the upper and lower dispersing filters and the base pad. The base pad is impregnated with a deodorant composition and, when the deodorant composition has dissipated from the pad during use, the assembly is simply thrown away.

An object of the present invention is to provide a splash proof urinal receptacle and pad assembly in which the receptacle has a peripheral wall and a pair of generally parallel, vertically spaced urine dispersing filters at the top. The upper dispersing filter preferably forms the top surface of the receptacle and the lower dispersing filter is spaced below the upper dispersing filter. Both dispersing filters are constructed of spaced parallel rod-like members with the rod-like members in the lower dispersing filter being at a substantial angle, preferably perpendicular, in relation to the rod-like elements in the upper dispersing filter.

Another object of the present invention is to provide a urinal deodorant receptacle and pad assembly including a flexible panel defining the base pad secured to the receptacle and including an enlarged central opening aligned with an outlet in the urinal for discharge of urine from the receptacle to the urinal outlet.

A further object of the invention is to provide a urinal deodorant receptacle having a peripheral wall with an opening therein above a shelf spaced below the lower dispersing filter and a deodorant block supported on the shelf immediately below the edge of the opening to enable insertion and replacement of the deodorant block and support of the deodorant block in alignment with and spaced below the lower dispersing filter.

Still another object of the invention is to provide a urinal receptacle including vertically spaced dispersing filters each of which includes a plurality of parallel rod-like members with the cross-sectional configuration of each rod-like member having a semi-cylindrical upper surface and a generally V-shaped lower surface, which V-shaped lower surface defines a narrow bottom edge to reduce the capillary action of the urine along the surfaces of the rod-like members and thus facilitate the discharge of the urine droplets from the lower surface of the rod-like members.

Yet another object of the invention is to provide a urinal receptacle in which the upwardly facing surfaces thereof are convexly curved to facilitate dispersion of the urine flow and eliminate flat surfaces which may cause splash back of urine when urine flow impinges upon such flat surfaces.

Yet a further object of the invention is to provide a urinal deodorant receptacle and pad assembly in which the flexible base pad is impregnated with a deodorant and in which the receptacle is relatively short in vertical height and includes only the upper and lower dispersing filters in order to be economically disposable.

Yet another object of this invention to be specifically enumerated herein is to provide a urinal deodorant receptacle and pad assembly in accordance with the preceding objects which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
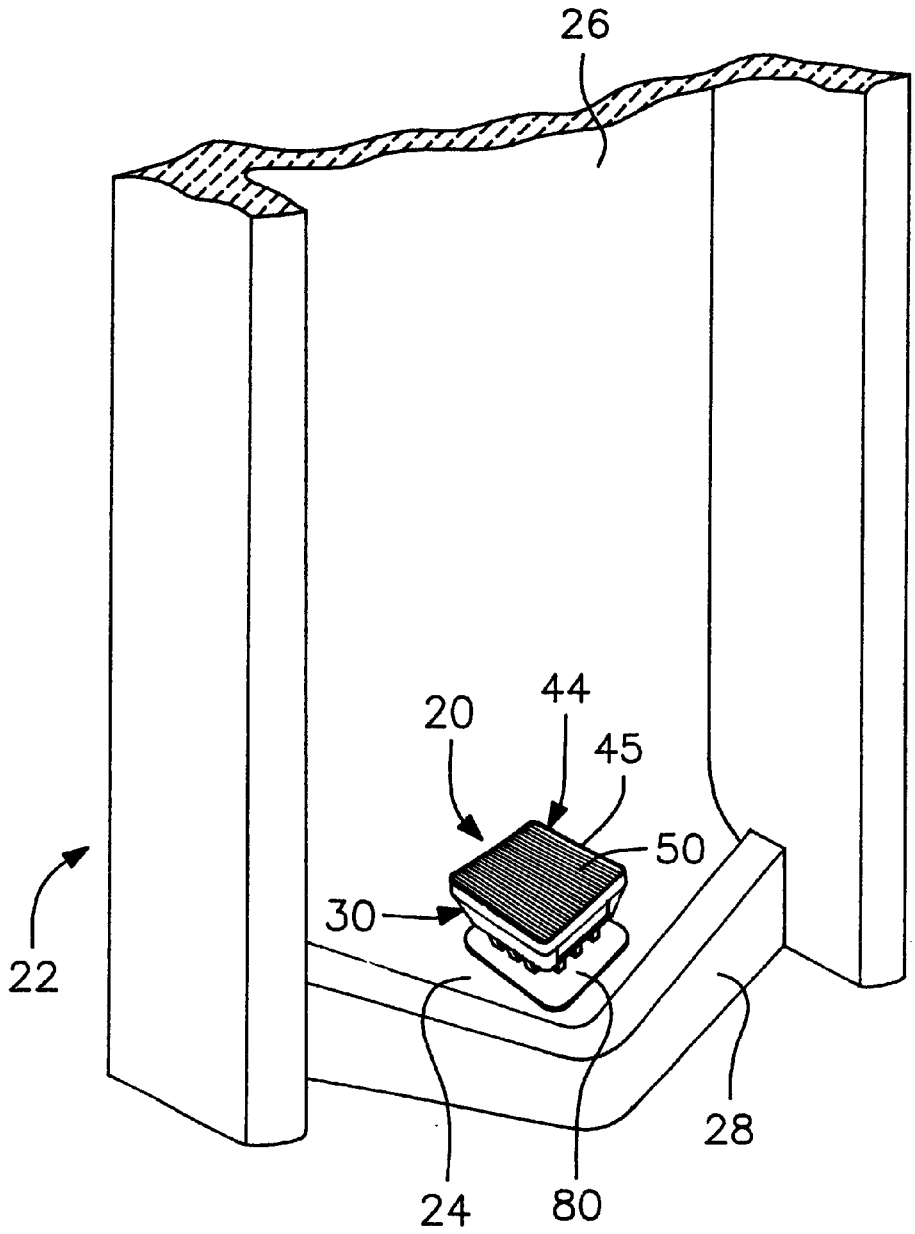
FIG. 1 is a perspective view of one embodiment of the splash proof urinal receptacle and pad assembly of the present invention installed in a typical urinal.
Figure 2:
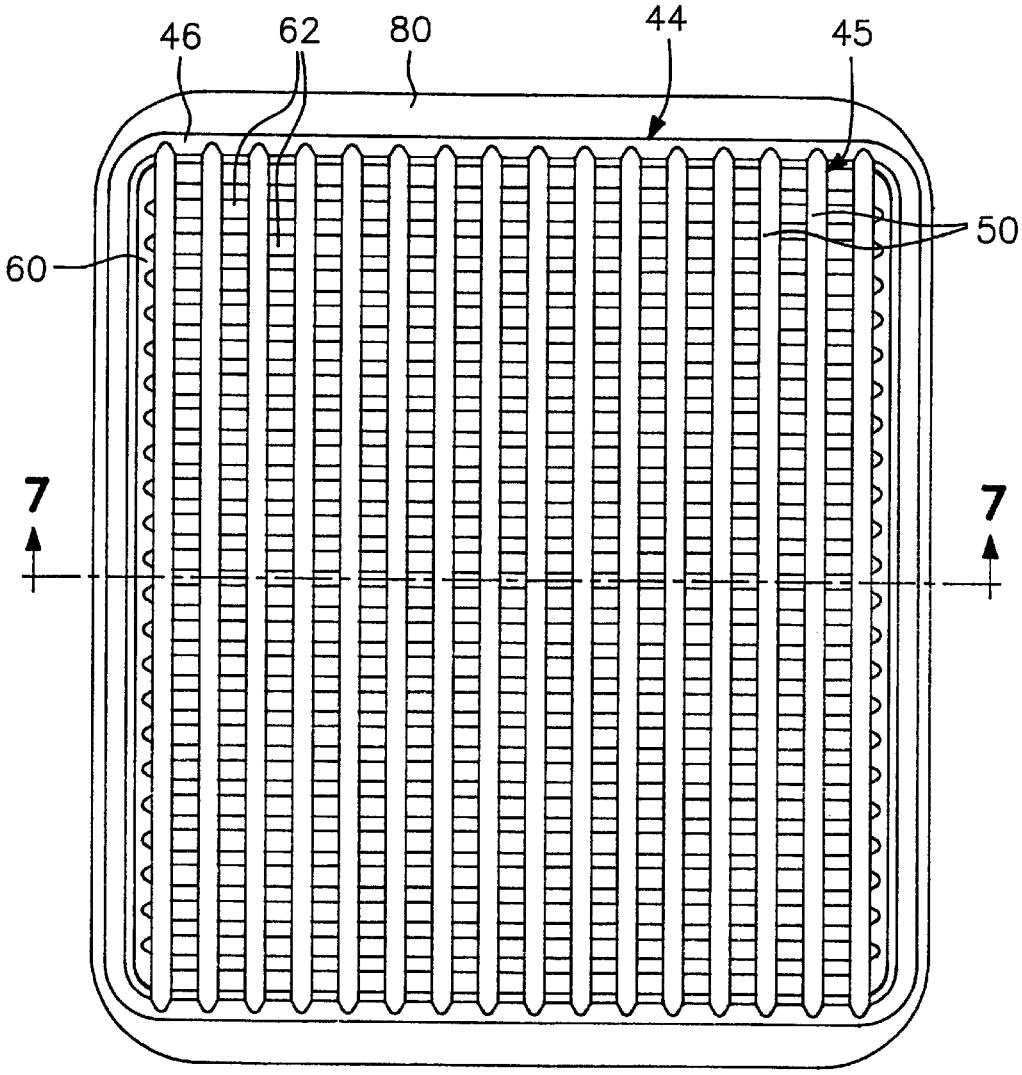
FIG. 2 is a top plan view of the receptacle shown in FIG. 1.

Although only two preferred embodiments of the invention are explained in detail, it is to be understood that the invention is not limited in its scope to the details of construction and arrangement of components set forth in the following description or illustrated in the drawings. The invention is capable of other embodiments and of being practiced or carried out in various ways. Also, in describing the preferred embodiments, specific terminology will be resorted to for the sake of clarity. It is to be understood that each specific term includes all technical equivalents which operate in a similar manner to accomplish a similar purpose.

FIG. 1 of the drawings illustrates one embodiment of the urinal receptacle and pad assembly of the present invention, generally designated by reference numeral 20. Assembly 20 is installed in a conventional urinal, generally designated by reference numeral 22, provided with an outlet (not shown) in the bottom wall 24 which extends between the back panel 26 and a lower front wall 28 extending upwardly above the bottom wall 24. The urinal 22 is of conventional construction and the receptacle 20 is positioned in overlying relation to the outlet and rests upon the surface of the bottom wall 24.

Figure 7:
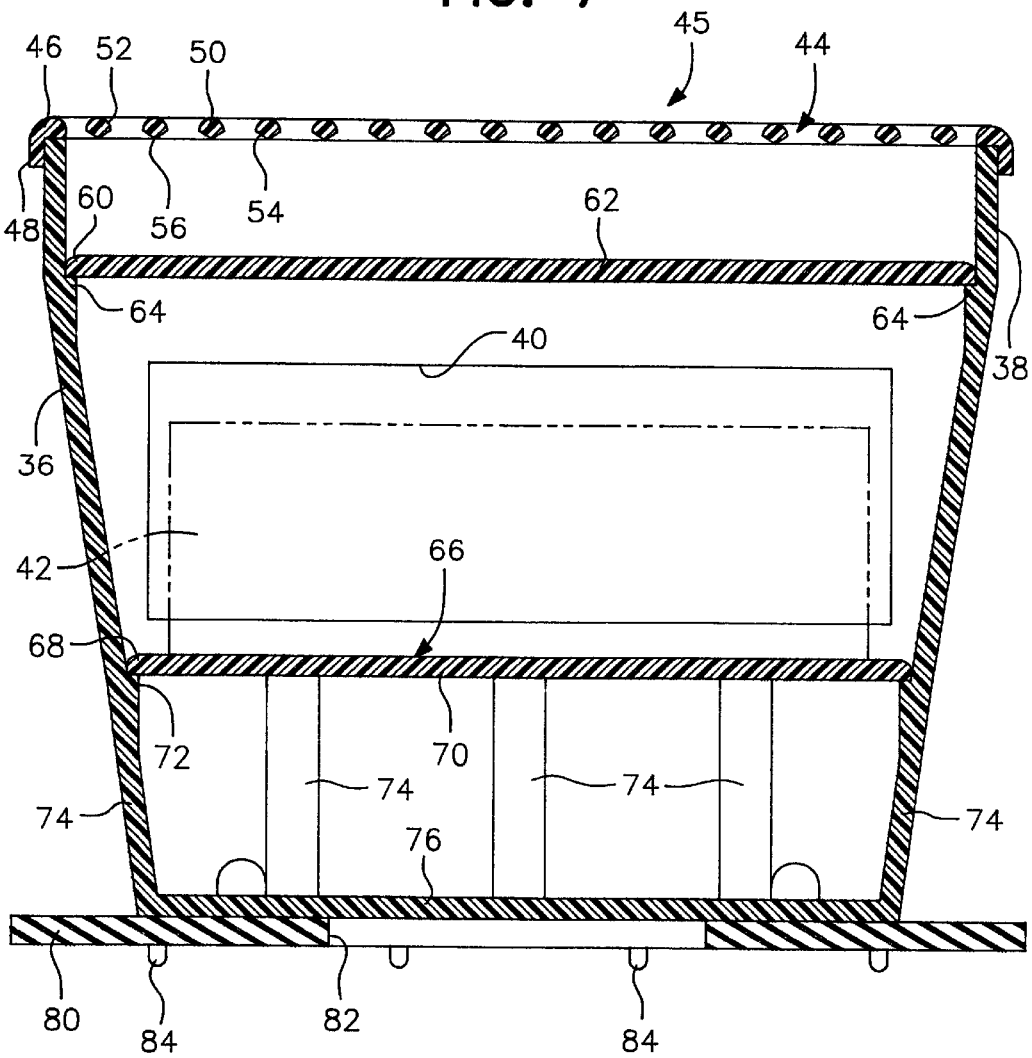
FIG. 7 is a vertical sectional view of the assembly, on an enlarged scale, taken along section line 7—7 on FIG. 2, illustrating the vertically spaced upper and lower dispersing filters, the cross-sectional configuration of the rod-like members forming the dispersing filters and the deodorant block supported on a supporting shelf below the lower dispersing filter.
Figure 9:
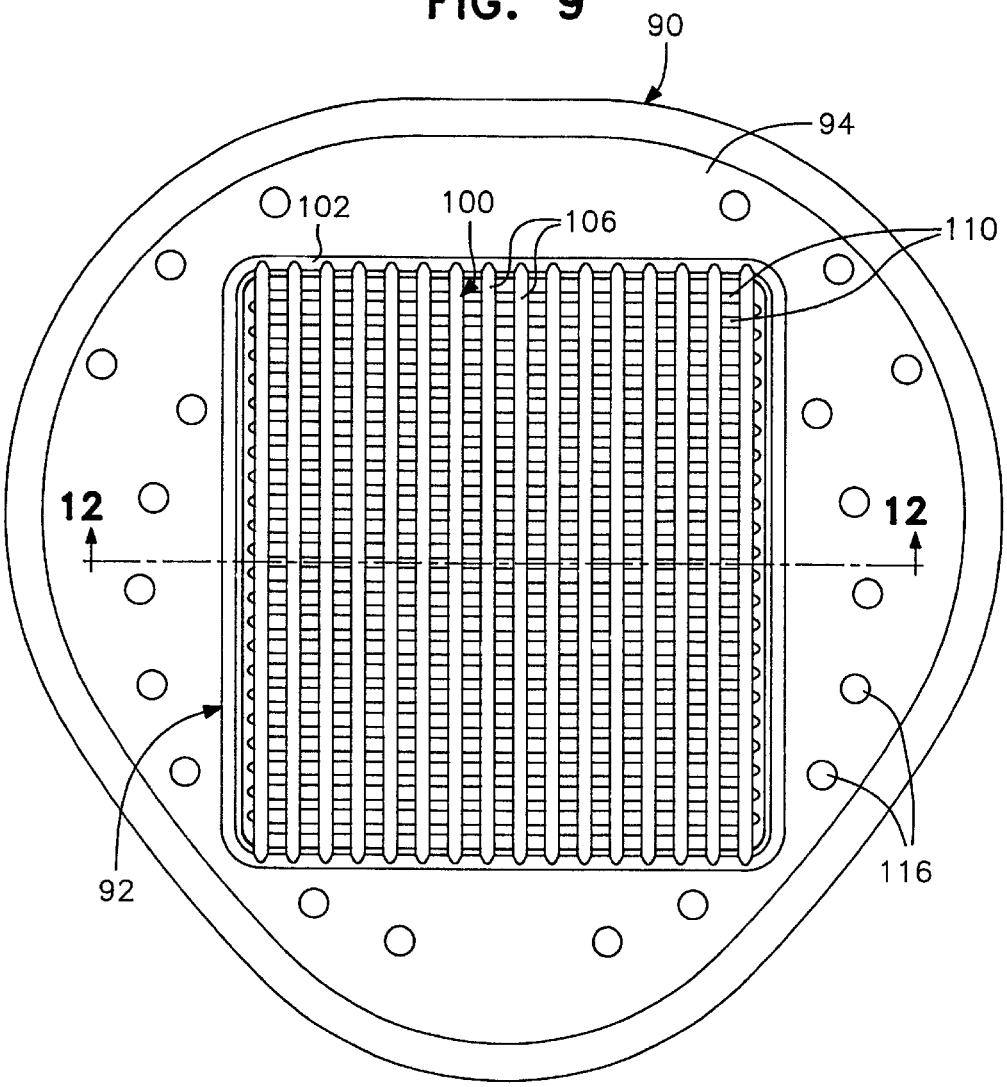
FIG. 9 is a top plan view of a second embodiment of the present invention.
Figure 11:
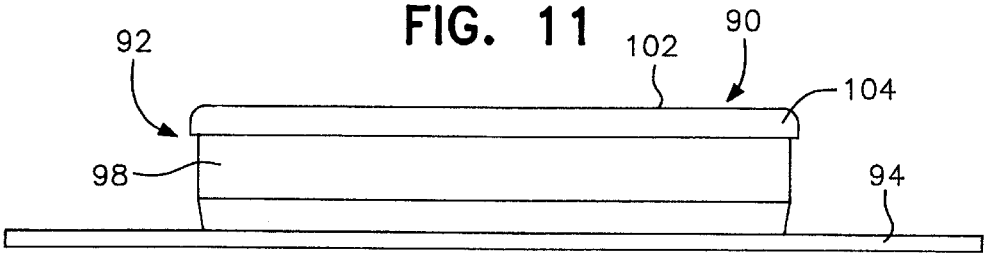
FIG. 11 is a side elevational view of the receptacle and pad assembly of FIG. 9.
Figure 10:
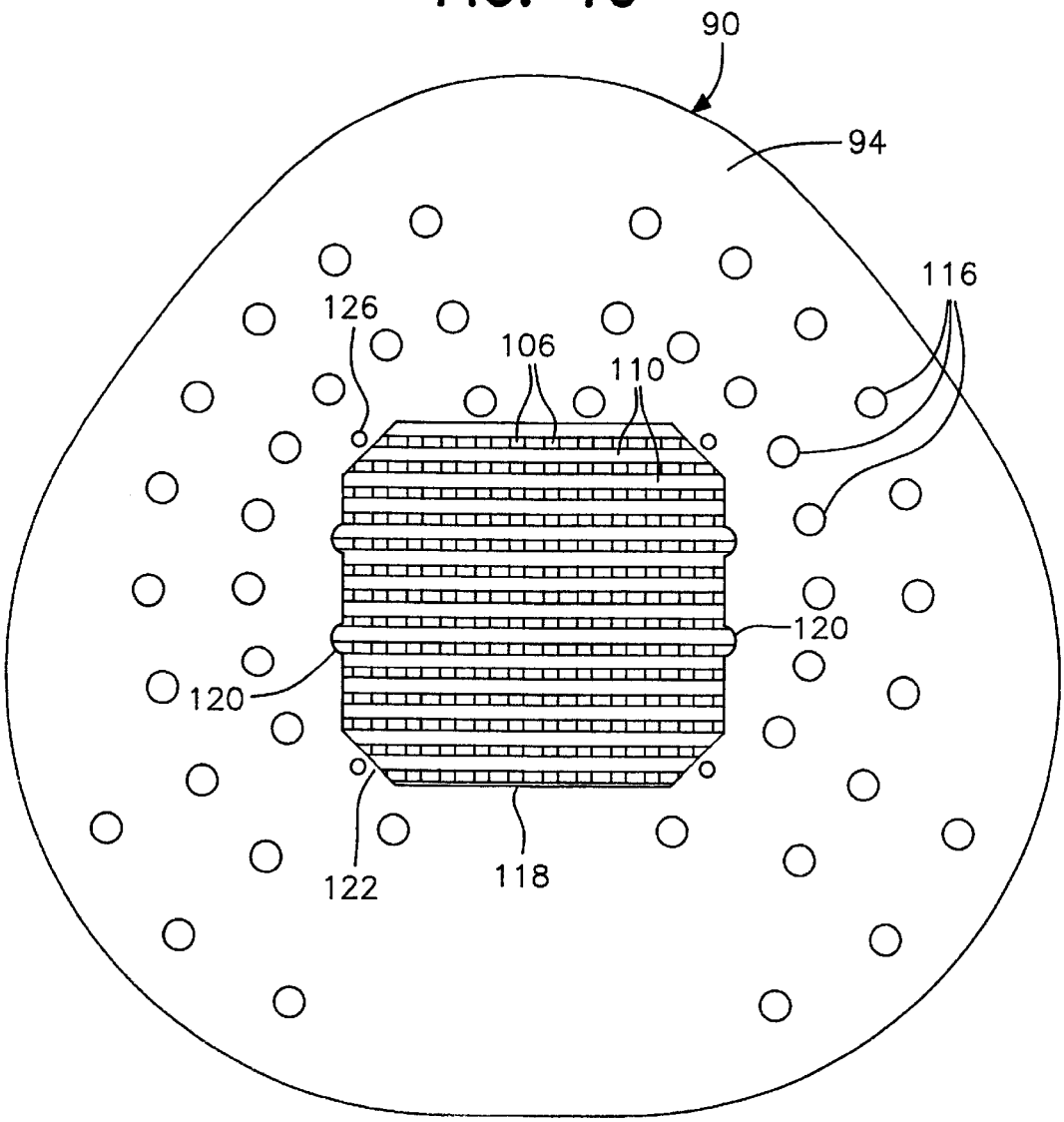
FIG. 10 is a bottom plan view of the embodiment of the invention shown in FIG. 9 illustrating the opening in the flexible base pad.
Figure 12:
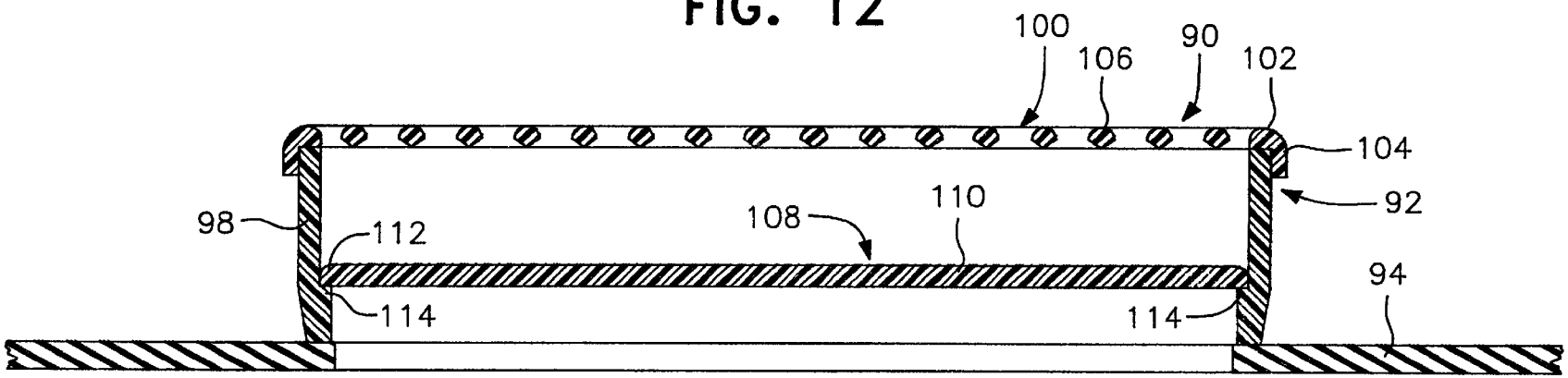
FIG. 12 is a sectional view, on an enlarged scale, of the assembly of FIG. 9 taken along section line 12—12 on FIG. 9.

As illustrated in FIGS. 2–8, the urinal assembly 20 includes an upwardly extending generally square or rectangular container or receptacle generally designated by reference numeral 30. The receptacle 30 includes a front wall 32, a rear wall 34 and side walls 36 of unitary construction. Each of the walls are preferably inclined downwardly and inwardly with an upper portion of each wall being vertically oriented as indicated by reference numeral 38. The front wall 32 includes an enlarged, generally rectangular opening 40 which enables insertion of a deodorant block 42 as shown in FIG. 7 in a manner described hereinafter.

The upper end of the receptacle 30 includes a one-piece cover or cap generally designated by reference numeral 44, in the form of an upper dispersing filter, generally designated by reference numeral 45. Upper dispersing filter 45 includes a peripheral member 46 having a down turned lip 48 which frictionally and detachably engages the external surface of the upper edge of the vertical upper portion 38 of the peripheral walls. The upper dispersing filter 45 includes a plurality of spaced parallel rod-like members 50 extending between opposite portions of member 46. Each rod-like member 50 include a generally semi-cylindrical upper surface 52 and a V-shaped lower surface 54 defining a narrow knife edge 56.

Positioned below the upper dispersing filter 45 is a lower dispersing filter, generally designated by reference numeral 58, which includes a peripheral member 60 and a plurality of rod-like members 62. The rod-like members 62 in the lower dispersing filter 58 have the same transverse configuration as the rod-like members 50 in the upper dispersing filter 45. The peripheral member 60 of the lower dispersing filter 58 rests upon a plurality of inward projections 64 oriented in spaced relation along the side walls 36 at the juncture of the side walls 36 with the vertical upper portions 38 as illustrated in FIG. 7.

Below the lower edge of the opening 40, a supporting shelf 66 is provided for the deodorant block 42 which has been inserted through the opening 40. As illustrated in FIG. 7, the block 42 drops downwardly onto the shelf 66 after insertion through opening 40 with partial wall 65 serving to retain the bottom edge of block 42 on shelf 66. The shelf 66 is smaller than the dispersing filters 45 and 58 and includes a peripheral member 68 and a plurality of parallel, spaced rod-like members 70. The rod-like members 70 preferably have the same cross-sectional configuration as the rod-like members 50 and 62 in the dispersing filters 45 and 58. However, the rod-like members 70 are spaced apart a greater distance than the rod-like members 50 and 62. The shelf 66 is supported by a plurality of inward projections 72 on the interior surface of each of the side walls 36 at a position generally aligned with the bottom edge of the side walls 36. The bottom shelf 66 is preferably spaced about 1 inch above the bottom surface of the urinal to prevent the deodorant block from excessive deterioration when flushing the urinal.

Each of the walls 32, 34 and 36 includes spaced downwardly extending narrow wall extensions 74 which are continuations of the inclined walls and which are spaced apart as illustrated in FIGS. 4–8. These extensions 74 terminate in spaced bottom straps 76 which intersect with each other in the same plane and define large openings between the extensions 74 and the bottom straps 76 as illustrated in FIGS. 3–7.

Figure 3:
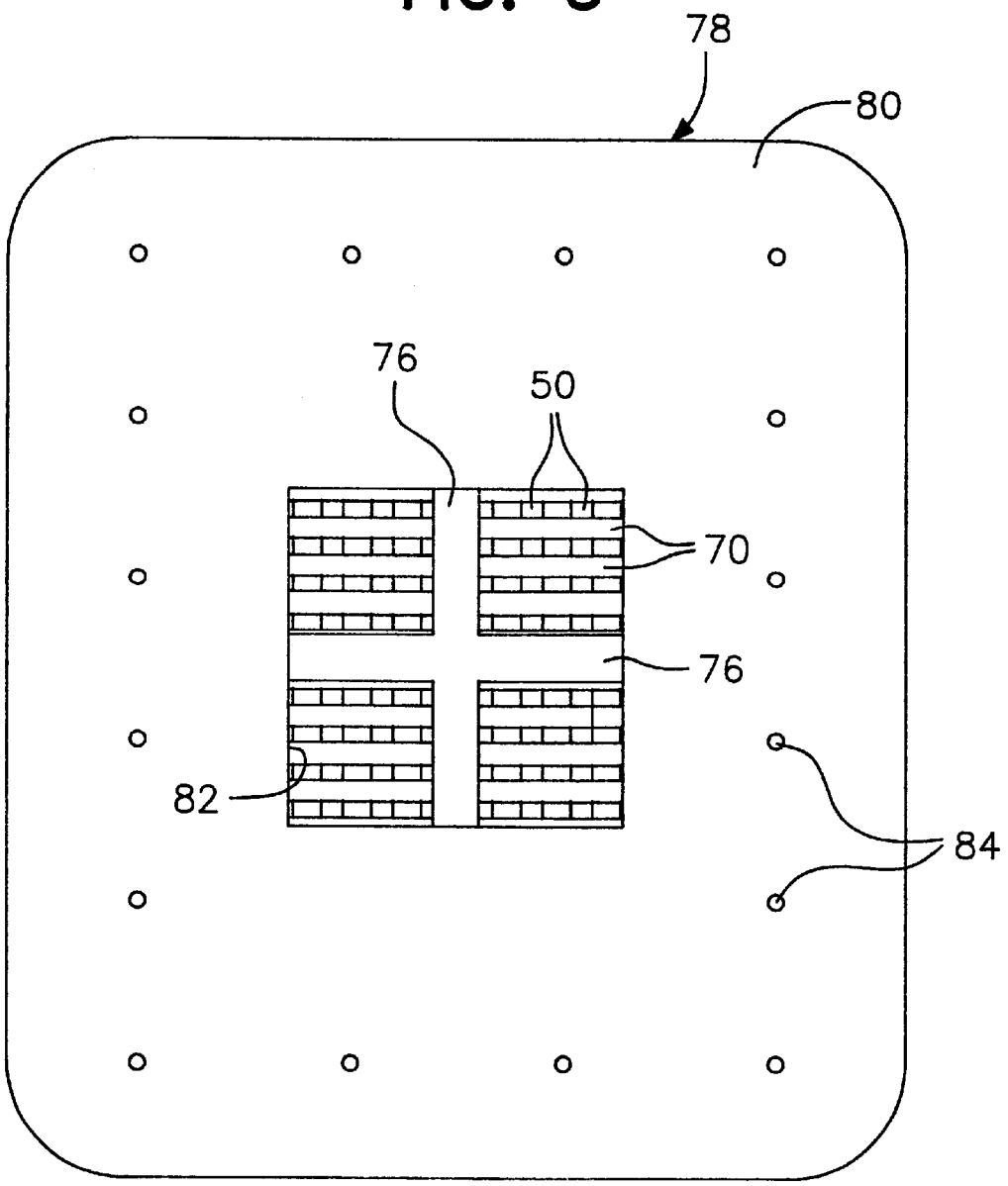
FIG. 3 is a bottom plan view of the embodiment shown in FIG. 1 illustrating the base pad and the central large opening therein.
Figure 4:
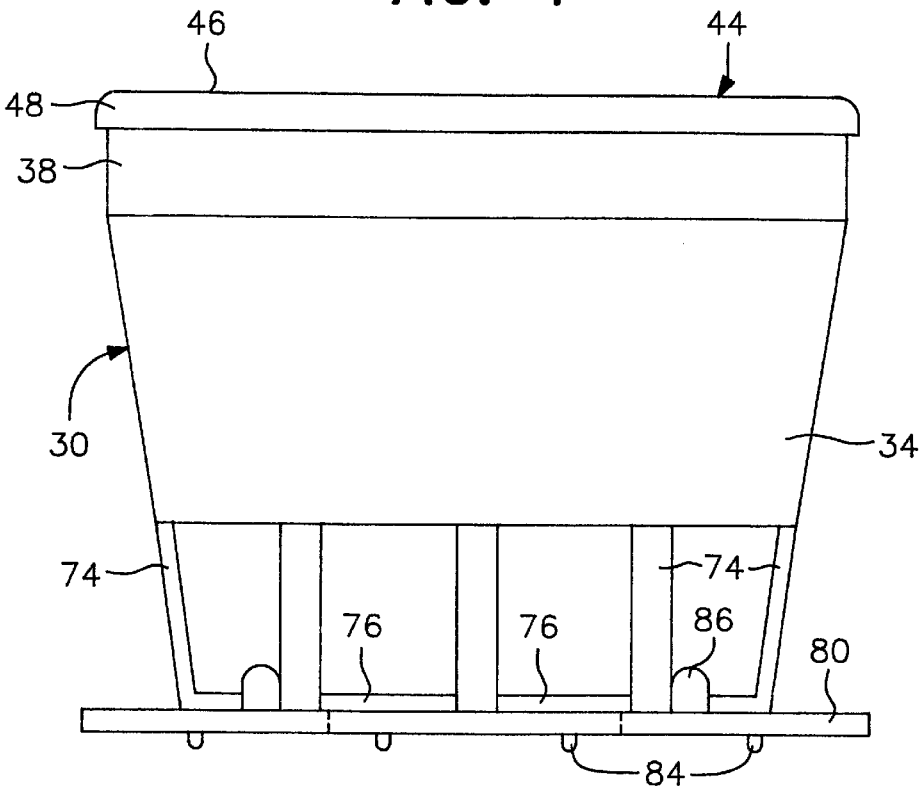
FIG. 4 is a rear elevational view of the assembly of FIG. 1.
Figure 5:
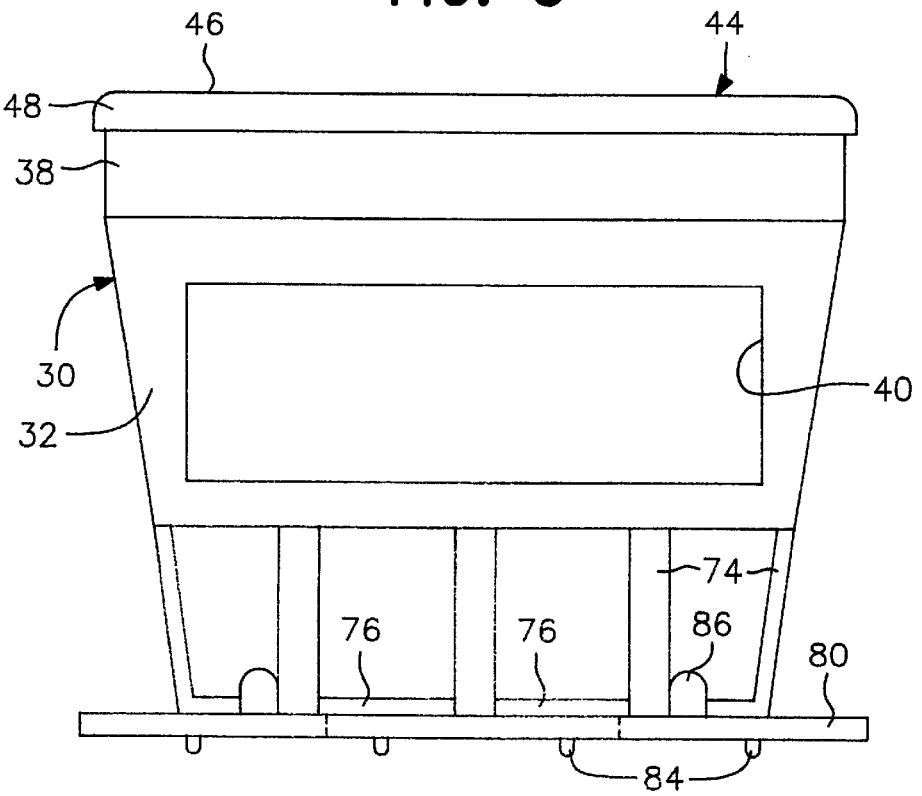
FIG. 5 is a front elevational view of the assembly of FIG. 1.
Figure 6:
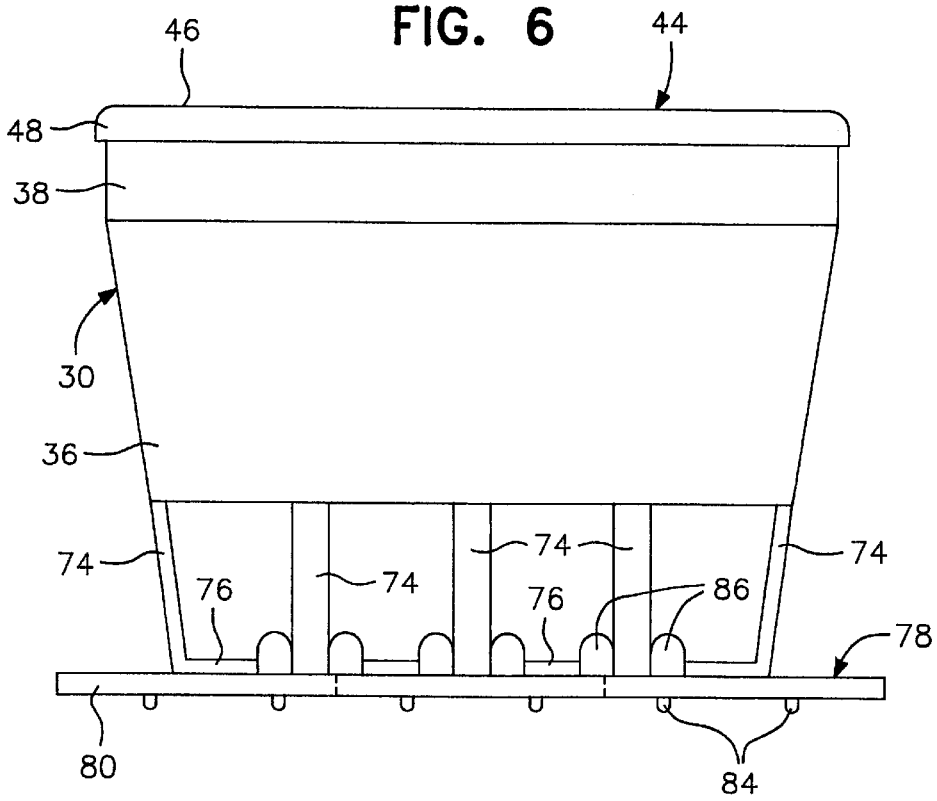
FIG. 6 is a side elevational view of the assembly of FIG. 1.

Connected to the receptacle 30 is a flexible base pad, generally designated by reference numeral 78, in the form of a rectangular panel 80 constructed of plastic or other material which extends peripherally outwardly beyond the bottom end of the receptacle 30 and includes a centrally located enlarged square opening 82 as illustrated in FIGS. 3 and 7. The pad 78 serves to properly align the attached receptacle 30 in the urinal 22 so that the upper dispersing filter 45 is positioned to receive the urine flow.

The bottom surface of the panel 80 is preferably provided with a plurality of short projections 84 which space the bottom surface of the base pad 78 from the surface of the bottom wall 24 of the urinal 22 to enable liquid flow along the surface of the bottom wall 24 of the urinal. The upper surface of the panel 80 is provided with a plurality of pairs of upward projections 86 integral with the panel 80 and oriented outwardly of the corners of the opening 82. The spacing of the pairs of projections 86 and the spacing of the projections 86 in each pair is dimensioned to frictionally grip the outermost bottom straps 76. Thus, as illustrated, the two pairs of projections 86 engage the opposite sides of the outermost bottom straps 76 which extend from side-to-side of the receptacle 30. Likewise, the projections 86 on opposite sides of the opening 82 engage the edges of the outermost bottom straps 76 which extend from front-to-rear of the receptacle 30. This provides a frictional resilient gripping engagement between the lower end of the receptacle 30 and the flexible, resilient base pad 78.

Figure 8:
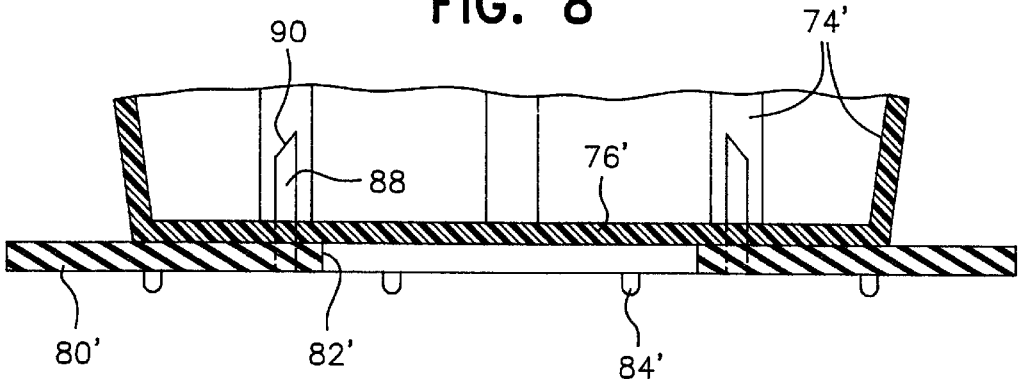
FIG. 8 is a sectional view of the lower portion of the receptacle and pad assembly illustrating an alternative structure for supporting the flexible pad from the lower end of the receptacle.

FIG. 8 illustrates a modified structure for securing base pad 78' to the bottom straps 76'. In this embodiment, a plurality of rigid fasteners 88 provided with slanted and pointed upper ends 90 are rigidly affixed to the flexible resilient base pad 78' adjacent the periphery of the opening 82' for penetrating the outer bottom straps 76' which extend from the front-to-rear of the receptacle. Other than the manner of attaching the base pad 78' to the bottom straps 76', the remainder of the structure in FIG. 8 is the same as in FIGS. 1–7.

The opening 40 in the front wall 32 of the receptacle in FIGS. 1–8 enables the deodorant block 42 to be readily replaced when necessary. The base pad stabilizes the receptacle and directs urine flow toward the region of the urinal outlet. As illustrated in FIG. 1, the opening 40 in the front wall 32 of the receptacle should face the user of the urinal 22 and toward the front of the urinal 22. This provides easy access to the opening 40 for the deodorant block refills and aligns the rod-like members 50 in the upper dispersing filter 45 parallel with the urine flow.

FIGS. 9–13 illustrate another embodiment of the present invention in the form of a urinal receptacle and pad assembly generally designated by reference numeral 90. The assembly 90 is simpler and less expensive in construction than assembly 20 thereby rendering assembly 90 economically feasible to be used as a disposable unit.

This embodiment of the invention includes a filter and dispersion assembly 92 mounted on a flexible deodorized resilient base pad 94. The dispersion assembly 92 includes a peripheral vertical wall 98 having an upper urine dispersing filter 100 in the form of a cap or cover attached to the upper end thereof. The upper dispersing filter 100 includes a peripheral member 102 with a down turned lip 104 which frictionally and telescopically engages the upper edge of the vertical wall 98. A plurality of rod-like members 106 are arranged in spaced parallel relation between opposite portions of the peripheral member 102.

Figure 13:
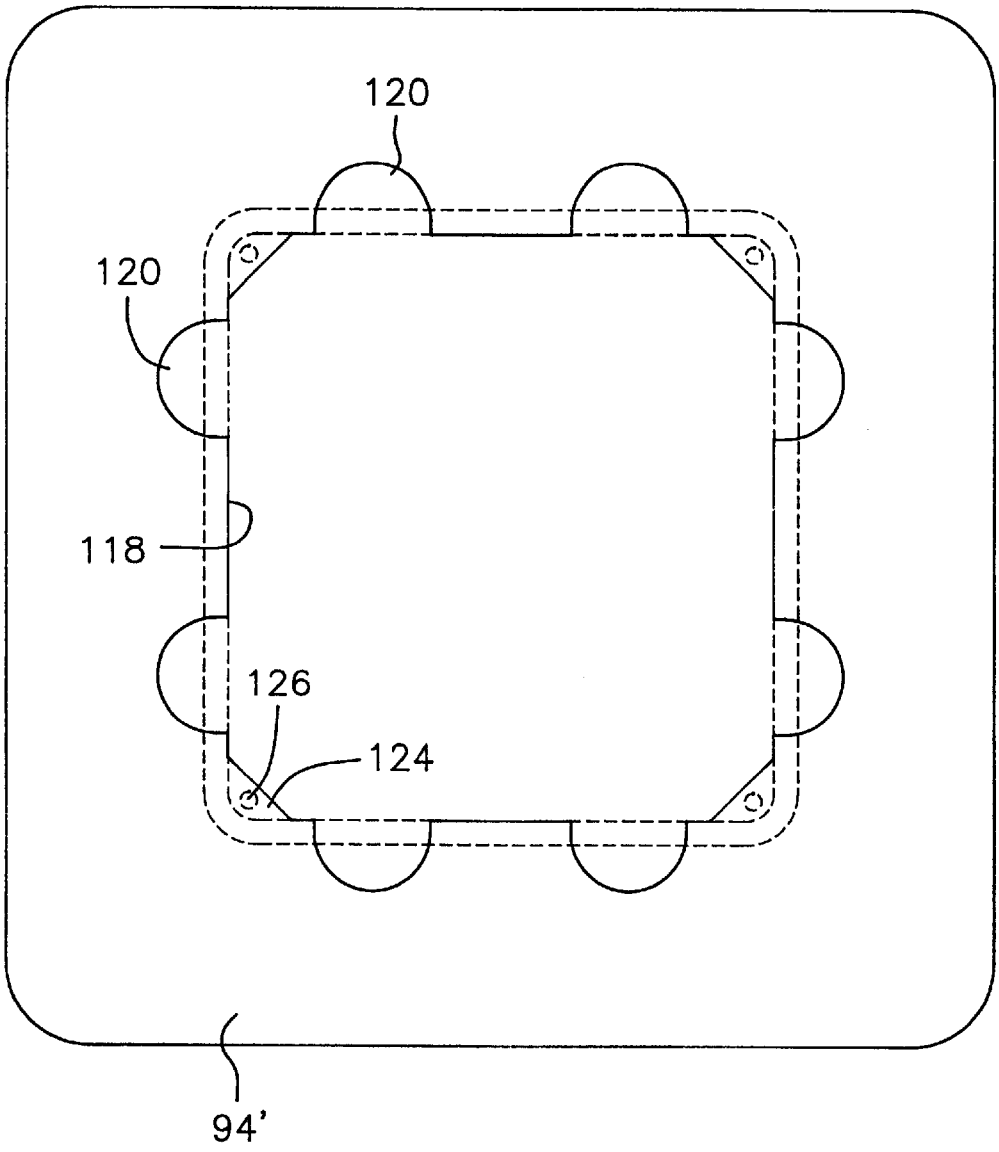
FIG. 13 is a plan view of an alternative base pad illustrating its association with the receptacle of FIG. 9.

Spaced below the upper dispersing filter 100 is a lower urine dispersing filter 108 including a plurality of spaced parallel rod-like members 110 that are perpendicular to the rod-like members 106 in the upper dispersing filter 100. The lower dispersing filter 108 includes a peripheral member 112 which rests against inward projections 114 on the interior of the peripheral wall 98. The lower external surface of the peripheral wall slants inwardly slightly and is connected to the flexible base pad 94. The base pad 94 may take any suitable configuration, such as the curved triangular shape illustrated in FIG. 9 or the square or rectangular shape as illustrated in FIG. 13 and designated as 94'. The base pad 94 is preferably provided with holes 116 therethrough at various locations. The center of the base pad 94 or 94' is provided with an enlarged opening 118 for alignment with the outlet in the urinal. The internal periphery of the opening 118 may include recesses 120 to facilitate flow of water when flushing the urinal. As shown in FIG. 13, the base pad may be provided with diagonal corner portions 122 which underlie corner gusset portions 124 of the lower end of the filter and dispersion assembly 92, and pegs or pins 126 can secure the diagonal corners 122 of opening 118 in pad 94 to the gusset corners 124 (see FIG. 13).

The shape and spacing of the rod-like members 106 and 110 are the same as in FIGS. 1–8 with the upper surface being semi-cylindrical or rounded and the lower surface being V-shaped to define a narrow knife edge to reduce the retention of urine by capillary action. The pad 94 or 94' is impregnated with a deodorant in this embodiment of the invention, and the pad as well as the plastic components in both embodiments of the invention may also be impregnated with a deodorant material.

The present invention centralizes the flow of urine and directs it toward the region of the urinal outlet without any splash back onto the user of the urinal or any other part of the urinal. The size of the rod-like member cross-section and the distance between the upper and lower dispersing filters is important in achieving the benefits of the present invention, in particular, in eliminating any capillary action between the two dispersing filters. Preferably the rod-like members are about ⅛ inch in height and ⅛ inch in width. The lower dispersing filter should be spaced at a clearance of at least ¼ inch below the upper dispersing filter and, preferably, approximately ½ inch below the upper dispersing filter. Preferably, the rod-like members, such as members 50 of the upper dispersing filter 45, are perpendicular to the rod-like members of the lower dispersing filter, such as members 62 in the lower filter 58, although some substantial angle of rotation less than 90° would be acceptable.

In addition, the spacing of the rod-like members in the upper and lower dispersing filters is important in order to properly restrict and disperse the urine flow. Preferably, the open space between the rod-like members in the upper dispersing filter is greater than the open space between the rod-like members in the lower dispersing filter so that the upper dispersing filter will accept and disperse the urine flow without splash back. It has been found that the open space between adjacent rod-like members in the upper dispersing filter should be about ⅛ inch, and the open space between adjacent rod-like members in the lower dispersing filter should be about 1⁄16 inch. In the first embodiment of the present invention, the closer together rod-like members in the lower dispersing filter maximizes dispersion and containment of the urine flow after it hits the deodorant block and prevents any splash back therefrom. The combination of the semi-cylindrical upper surface of each of the rod-like members in the upper and lower dispersing filters and the V-shaped lower edge reduces the capillary action of the urine which otherwise would tend to retain droplets of urine if the rod-like members had a cylindrical configuration.

The other dimensional characteristics of the urinal deodorant receptacle illustrated in FIGS. 1–8 may vary within certain prescribed limits. The receptacle is preferably square with each side ranging between 4 and 5 inches in length. The height of the embodiment disclosed in FIGS. 1–8 preferably ranges between 3 and 4 inches and the pad may have a thickness of about ¼ inch. The corners of the receptacle may be rounded and reinforced as necessary and constructed of any suitable plastic material and of any desired color. The assembly 92 illustrated in FIGS. 9–13 has the same perimetrical dimensions but has a vertical height of only about 1½ inches.

The receptacles of the present invention are made of any conventional plastic material known for molding or forming semi-rigid plastic products of this type. The flexible base pads for this invention are also made from conventional plastic or other materials well-known for making flexible, liquid-impervious pad-like products.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A urinal receptacle and pad assembly adapted to be positioned on the bottom wall of a urinal having an outlet opening, said assembly comprising a base pad for positioning on the bottom wall of the urinal, a receptacle having an upstanding peripheral wall connected to said base pad, said peripheral wall including an upper urine dispersing filter at the upper end of the peripheral wall and a lower urine dispersing filter mounted interiorly of said peripheral wall in vertically spaced relation below the upper dispersing filter, said base pad including a large centrally located opening for alignment with the outlet in the bottom wall of the urinal, each of said dispersing filters including a plurality of spaced parallel rods with the rods in the upper dispersing filter being approximately perpendicular to the rods in the lower dispersing filter for dispersing urine flow without splash back toward a user of the urinal.

2. The receptacle and pad assembly as defined in claim 1, wherein said upper dispersing filter is in the form of a cap removably attached to the upper edge of the peripheral wall.

3. The receptacle and pad assembly as defined in claim 1, wherein said base pad is flexible, said upstanding peripheral wall including a bottom portion connected to said base pad.

4. The receptacle and pad assembly as defined in claim 3, wherein the rods in each of the dispersing filters includes a cylindrical upper surface and a V-shaped lower surface defining a narrow edge to facilitate dispersion of the urine flow and reduce capillary action along the surfaces of the rods.

5. The receptacle and pad assembly as defined in claim 4, wherein said peripheral wall includes a shelf extending transversely of the peripheral wall below the lower filter, said shelf including a plurality of parallel, spaced rods, and an access opening in said peripheral wall above the shelf to provide access to the upper surface of the shelf to enable a deodorant block to be positioned on the shelf through the access opening.

6. The receptacle and pad assembly as defined in claim 5, wherein said access opening is positioned toward a user of the urinal and said rods in the upper dispersing filter are parallel to the urine flow for effective dispersion between the rods which generally parallel the urine flow.

7. The receptacle and pad assembly as defined in claim 6, wherein said peripheral wall includes a plurality of spaced extensions depending from the peripheral wall and extending along a portion of the top surface of said base pad, a securing structure engaging portions of the extensions extending along a top surface of said pad for connecting the pad to the peripheral wall.

8. The receptacle and pad assembly as defined in claim 7, wherein said securing structure includes a plurality of pegs rigidly affixed to the base pad and extending through the extensions extending along the top surface of the base pad.

9. The receptacle and pad assembly as defined in claim 7, wherein said securing structure includes a plurality of pairs of resilient projections on an upper surface of said base pad, said projections engaging opposing edges of portions of the extensions extending along the top surface of the base pad for detachably securing the base pad to the peripheral wall.

10. The receptacle and pad assembly as defined in claim 1, wherein said peripheral wall includes inwardly extending projections to support the lower dispersing filter.

11. The receptacle and pad assembly as defined in claim 10, wherein said lower dispersing filter is positioned intermediate the base pad and upper dispersing filter.

12. The receptacle and pad assembly as defined in claim 11, wherein said lower dispersing filter is positioned closer to the upper dispersing filter than to the base pad, a deodorant block supporting shelf positioned between the lower dispersing filter and base pad, said peripheral wall including an access opening to enable a deodorant block to be placed on the shelf interiorly of the peripheral wall.

13. The receptacle and pad assembly as defined in claim 11, wherein said opening in the base pad is substantially the same size as a bottom end of said peripheral wall.

14. The receptacle and pad assembly as defined in claim 11, wherein said base pad includes a plurality of projections on a lower surface to space the base pad from the bottom of the urinal.

15. The receptacle and pad assembly as defined in claim 11, wherein said peripheral wall, dispersing filters and base pad include opposed parallel side edges, said peripheral wall and dispersing filters being of plastic material and said base pad being flexible material with the material of the receptacle, dispersing filters and base pad being capable of impregnation with deodorant material.

16. A urine dispersing device adapted to be placed in a urinal to prevent back splash of urine when using the urinal, said device comprising an upstanding peripheral wall, a plurality of spaced parallel rods at the top of said peripheral wall, a plurality of spaced parallel rods at an intermediate portion of said peripheral wall, a flexible base pad attached to said peripheral wall and adapted to be supported in a urinal with rods at the top of said peripheral wall being parallel to a urine flow path for dispersing the urine without back splash, said base pad including an opening for registry with an outlet in a bottom portion of a urinal for discharge of urine.

17. The device as defined in claim 16, wherein each of said rods includes a convex upper surface and a V-shaped lower surface to reduce capillary action of urine on surfaces of the rods.

18. A receptacle and pad assembly adapted to be placed in a urinal to prevent back splash of urine when using the urinal, said assembly comprising:

a base pad;

an upstanding peripheral wall connected to said base pad;

a urine dispersing assembly mounted at the upper end of said peripheral wall;

said urine dispersing assembly including an upper dispersing filter mounted at the top of said peripheral wall and forming a top of said receptacle and a lower dispersing filter supported below said upper dispersing filter in generally parallel relation thereto;

said pad having a central opening for alignment with an outlet of said urinal;

said upper and lower dispersing filters having a plurality of spaced parallel rod-like members, each rod-like member having a convexly curved upper surface and a V-shaped lower surface defining a narrow bottom edge.

19. The receptacle and pad assembly as defined in claim 18, wherein said spaced parallel rod-like members of said lower dispersing filter are oriented at a substantial angle from said spaced parallel rod-like members of said upper dispersing filter.

20. The receptacle and pad assembly as defined in claim 18, wherein said plurality of spaced parallel rod-like members of said lower dispersing filter is approximately perpendicular to said plurality of spaced parallel rod-like members of said upper dispersing filter.

* * * * *